US007571704B2

(12) United States Patent
Fujima

(10) Patent No.: US 7,571,704 B2
(45) Date of Patent: Aug. 11, 2009

(54) INTERNAL COMBUSTION ENGINE PROVIDED WITH ELECTRICAL EQUIPMENT HOLDER

(75) Inventor: Akifumi Fujima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 174 days.

(21) Appl. No.: 11/807,174

(22) Filed: May 25, 2007

(65) Prior Publication Data

US 2007/0277796 A1 Dec. 6, 2007

(30) Foreign Application Priority Data

May 31, 2006 (JP) ..... 2006-152908

(51) Int. Cl.
*F02B 67/00* (2006.01)

(52) U.S. Cl. ..... 123/195 E

(58) Field of Classification Search ..... 123/195 A, 123/195 E, 195 P, 195 C
See application file for complete search history.

(56) References Cited

U.S. PATENT DOCUMENTS 5,568,794 A * 10/1996 Tabuchi et al. ..... 123/195 E
6,318,329 B1 * 11/2001 Sato ..... 123/192.1
6,487,995 B2 * 12/2002 Markyvech et al. ..... 123/41.31
7,380,533 B2 * 6/2008 Tsubouchi et al. ..... 123/195 P
7,421,997 B2 * 9/2008 Ishizaka et al. ..... 123/198 E
2007/0251488 A1 * 11/2007 Fujima et al. ..... 123/195 P

FOREIGN PATENT DOCUMENTS

JP 10-176541 6/1998
JP 2001-260983 9/2001

* cited by examiner

*Primary Examiner*—Hai H Huynh
(74) *Attorney, Agent, or Firm*—Carrier, Blackman & Associates, P.C.; Joseph P. Carrier; William D. Blackman

(57) ABSTRACT

An internal combustion engine has a cylinder block 20 and is provided with an electrical equipment box A disposed outside the cylinder block 20. A plurality of electrical parts including an ECU 52, a relay box 53 and couplers 54, 55 and 56 are held in the electrical equipment box A. The ECU 52, the relay box 53 and the couplers 54, 55 and 56 are arranged in layers in the electrical equipment box A. The electrical equipment box A has a bottom wall 61 holding the relay box 53, and is provided with a stay 80 holding the ECU 52 and the couplers 54, 55 and 56. The electrical equipment box A facilitates securing a space in which the electrical equipment box A is disposed outside the engine body of the internal combustion engine.

10 Claims, 11 Drawing Sheets

INTERNAL COMBUSTION ENGINE PROVIDED WITH ELECTRICAL EQUIPMENT HOLDER

BACKGROUND OF THE INVENTION

1. Field of the Invention

The present invention relates to an internal combustion engine having an engine body and provided with an electrical equipment holder which holds electrical parts and is attached to the engine body. More specifically, the present invention relates to an internal combustion engine intended for use on, for example, an outboard motor, and to a construction of an electrical equipment holder attached to the internal combustion engine.

2. Description of the Related Art

An internal combustion engine is provided with many electrically operated engine parts (hereinafter, referred to as "electrical engine parts") including spark plugs and a fuel supply system. As disclosed in, for example, JP-A 10-176541 and JP-A 2001-260983, an electrical equipment holder, which holds electrical parts including a control unit and couplers connected to the electrical engine parts, is attached to the engine body of an internal combustion engine.

The number of electrical engine parts of the internal combustion engine mounted on a machine has progressively increased with the development of electronic control systems for the electronic control of operations of the internal combustion engine. Consequently, the number of electrical parts connected to the electrical engine parts has increased or the sizes of the electrical parts have increased. Many engine parts of engine accessories including an intake system, a cooling system and a lubricating system are arranged around the engine body. If the electrical parts are held in a planar arrangement in an electrical equipment holder, the electrical equipment holder becomes inevitably large. When the internal combustion engine provided with the large electrical equipment holder is incorporated into a comparatively small machine, such as an outboard motor, it is difficult to secure a space for the large electrical equipment holder around the engine body.

When electrical parts held in the electrical equipment holder include an electric control device, heat generated by the electric control device affects the performance of the other electrical parts. The electrical equipment holder needs to be formed in a large size if the electric control device is merely separated from the other electrical parts in a plane to reduce the thermal influence of the electric control devices on the electrical parts and to ensure efficient dissipation of heat generated by the electric control devices.

Increase in the size of the electrical equipment holder resulting from the planar arrangement of electrical parts in the electrical equipment holder may be prevented by contiguously placing other electrical parts on the electrical parts attached to the electrical equipment holder. However, such a layered arrangement of the electrical parts entails the following problems attributable to the contiguous, layered arrangement of the other electrical parts. The other electrical parts are susceptible to vibrations generated by the operation of the internal combustion engine because it is difficult to fixate the other electrical parts securely and it is possible that the electrical parts rub each other. When the electric control device is attached to the electrical equipment holder, the electrical part contiguous with the electric control device is liable to be subject to the thermal influence of the electric control device. Thus measures for avoiding the thermal influence of the electric control device on the electrical part are necessary and the dissipation of heat generated by the electric control device is reduced.

It is desirable to reduce the influence of the deformation of the electrical equipment holder and vibrations generated by the operation of the internal combustion engine on the electric control device in order to insure the reliability of the electric control device.

There are engine parts smaller than the electrical equipment holder, which is one of the engine parts and include a thermostat valve of the cooling system of the internal combustion engine. Such engine parts will be referred to as small engine parts. The small engine parts are disposed on the outer side of the engine body and are detachably attached to the engine body. The small engine parts can be easily removed from the engine body for maintenance when the electrical equipment holder is disposed not to obstruct the removal of the small engine parts. However, many other engine parts are disposed on the outside surface of the engine body and hence it is difficult to secure a proper space for the electrical equipment holder.

The present invention has been made under such circumstances and it is therefore an object of the present invention to facilitate securing a space, in which an electrical equipment holder can be installed, outside the engine body of an internal combustion engine.

Another object of the present invention is to facilitate securing a space for an electrical equipment holder by attaching a plurality of electrical parts in layers to the electrical equipment holder to form the electrical equipment holder in a small size and to solve problems resulting from the contiguous arrangement of the electrical parts.

A further object of the present invention is to provide an electrical equipment holder capable of being installed in a small space around the engine body of an internal combustion engine, of holding an electric control device and electrical parts such that the thermal influence of the electric control device on the other electrical parts is reduced and heat generated by the electric control device can be effectively dissipated, of being formed in a small size so that a space for the electrical equipment holder can be easily secured, and of facilitating securing a space for the electrical equipment holder by being disposed so as to cover engine parts in a direction in which the engine parts are removed from the engine body.

SUMMARY OF THE INVENTION

An internal combustion engine in a first aspect of the present invention includes: an engine body; and an electrical equipment holder holding a plurality of electrical parts; in which the electrical parts are held in a layered arrangement in the electrical equipment holder, the electrical equipment holder is provided with a plurality of holding parts arranged at intervals in a direction in which the electrical parts are layered, and each of the holding parts hold at least one of the electrical parts.

According to the present invention, the plurality of electrical parts are held in a three-dimensional arrangement by the plurality of holding parts arranged at intervals in a direction in which the electrical parts are arranged in layers, respectively. Therefore, a space for holding the electrical equipment holder can be easily secured around the engine body of the internal combustion engine because the electrical equipment holder does not need to have a large two-dimensional size and the electrical equipment holder can be made small. The electrical parts can be held in the electrical equipment holder with reliability and the electrical parts can be prevented from coming into contact with each other, vibrations of the electrical parts due to the operation of the internal combustion engine can be suppressed and troubles attributable to contact between the electrical parts can be solved or reduced because the electrical parts are held by the holding parts, respectively.

The electrical equipment holder may include a box-like body including a case and a cover, and attachments placed in the body, the body and the attachments forming the holding parts.

The plurality of electrical parts are held by both the attachments and the body. Therefore, the body is small as compared with that of an electrical equipment holder in which electrical parts are not attached to a case and a cover.

The body may define a holding space for holding the electrical parts therein, and the attachments may be placed in the holding space defined by the body.

The attachments placed in the holding space defined by the body enable efficient use of the space defined by the body for holding the electrical parts therein, and hence the electrical equipment holder can be formed in small size.

The electrical equipment holder may be disposed in a recess defined by a cylinder block and a cylinder head included in an engine body and depressed in a direction in which layers of the electrical parts are arranged.

The electrical equipment holder can be disposed close to the engine body with respect to a direction in which the layers of the electrical parts are arranged in the electrical equipment holder even if the electrical equipment holder has a large dimension with respect to the direction in which the layers of the electrical parts are arranged because the electrical equipment holder is disposed in the recess defined by the cylinder block and the cylinder head and depressed in the direction in which the layers of the electrical parts are arranged.

An internal combustion engine in another aspect of the present invention includes: an engine body; and an electrical equipment holder holding a plurality of electrical parts including an electric control device provided with a control circuit, and disposed outside the engine body; in which the electrical equipment holder has a bottom wall provided with a plurality of supporting bosses to which the electric control device is attached, and the plurality of supporting bosses are interconnected by a connecting member extending along the electric control device.

Since the electric control device is attached to the plurality of supporting bosses, the thermal influence of the electric control device, as compared with that of the electric control device placed on the bottom wall of the electrical equipment holder, on the other electrical parts is insignificant, heat generated by the electric control device can be efficiently dissipated, the electrical equipment holder may be small, and a space for the electrical equipment holder can be easily secured. The supporting bosses are rigid and resistant to the supporting boss deforming effect of vibrations generated by the operation of the internal combustion engine and intervals between adjacent ones of the supporting bosses will not change because the supporting bosses are interconnected by the connecting part, the electric control device is not deformed, vibrations of the electric control device are suppressed, and the reliability of the electric control device can be augmented.

An internal combustion engine in a further aspect of the present invention includes: an engine body; and an electrical equipment holder holding a plurality of electrical parts and disposed outside the engine body; in which the electrical equipment holder is attached to the engine body so as to cover an engine part detachably attached to the engine body in a removing direction in which the engine part is removed from the engine body and so as to form a working space opening in a direction perpendicular to the removing direction together with the engine body, and the engine parts can be attached to and removed from the engine body through the working space.

Thus the engine part does not place any restrictions on the disposition of the electrical equipment holder because the electrical equipment holder does not need to be disposed so as not to overlap the engine parts, and hence a space in which the electrical equipment holder is disposed relative to the engine body can be easily secured. The electrical equipment holder does not need to be removed from the engine body when the engine part is removed from and attached to the engine body for maintenance because the working space is formed between the engine body and the electrical equipment holder attached to the engine body. Thus the working space facilitates maintenance work.

DESCRIPTION OF THE PREFERRED EMBODIMENTS

An internal combustion engine in a preferred embodiment of the present invention will be described with reference to FIGS. 1 to 12.

Figure 1:
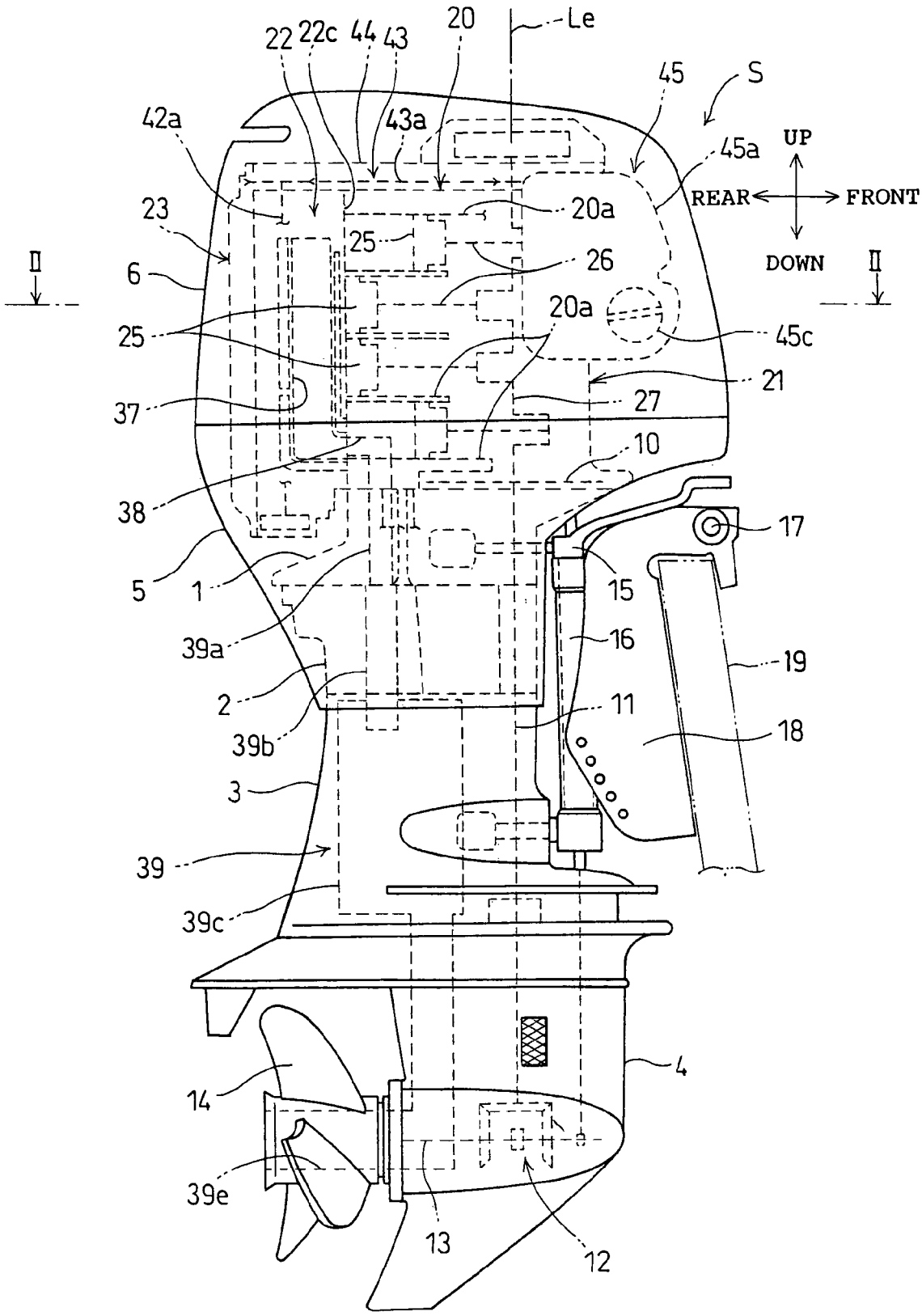
FIG. 1 is a schematic side elevation of an outboard motor provided with an internal combustion engine in a preferred embodiment of the present invention taken from the right-hand side of the outboard motor.

Referring to FIG. 1, an internal combustion engine E in a preferred embodiment of the present invention is incorporated into an outboard motor S. The outboard motor S includes the internal combustion engine E disposed with the center axis $L_e$ of its crankshaft 27 vertically extended, a mount case 1 supporting the internal combustion engine E, an oil case joined to the mount case 1; an extension case 3 joined to the lower end of the oil case 2, a gear case 4 joined to the lower end of the extension case 3, an under cover 5 covering a part between a lower part of the internal combustion engine E and an upper part of the extension case 3, and an engine cover 6 joined to the upper end of the under cover 5.

Figure 2:
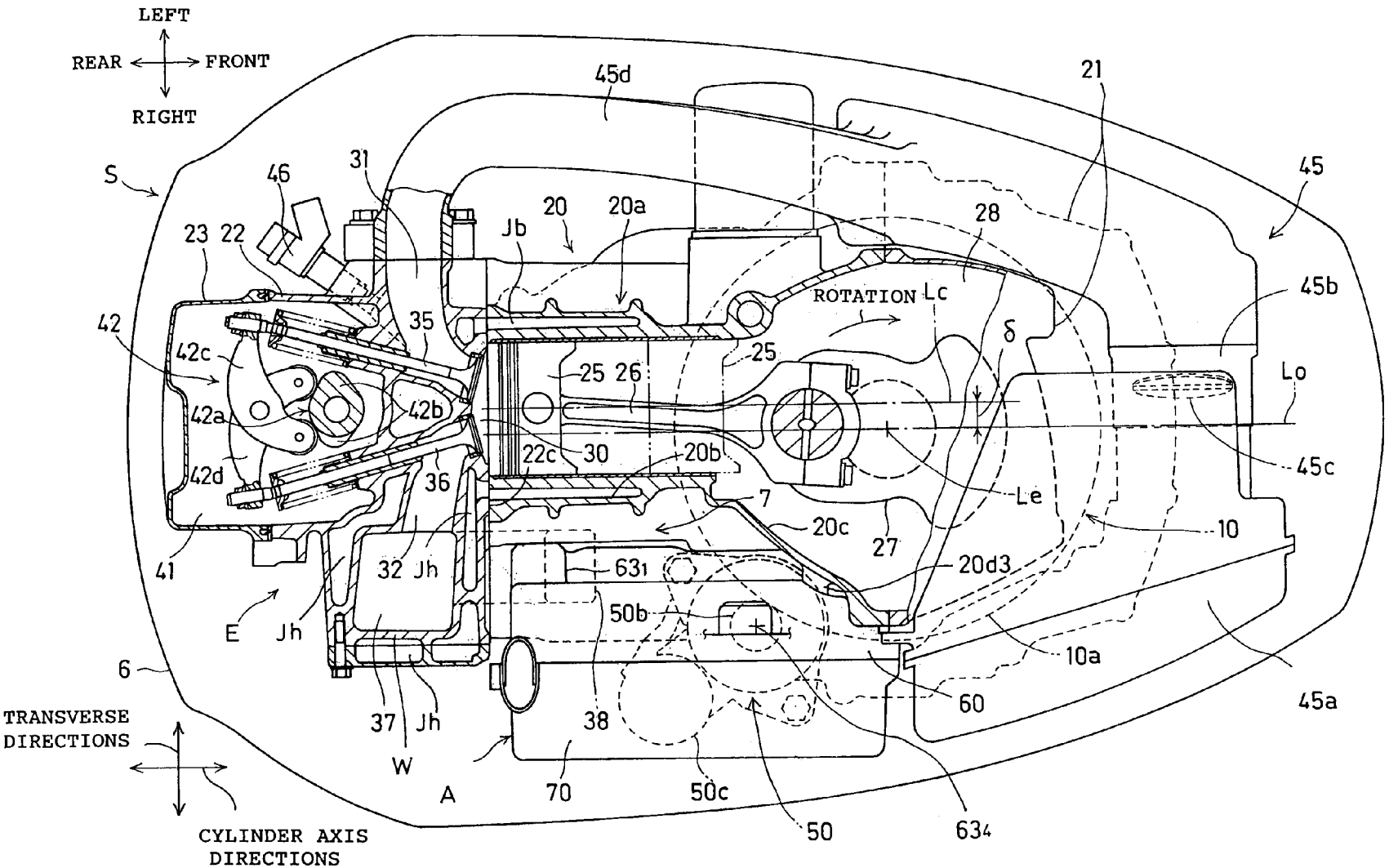
FIG. 2 is a cross-sectional view of an essential part including an electrical equipment holder taken on the line II-II in FIG. 1.

In this specification or appended claims, the terms "vertical", "longitudinal" and "lateral" are used for indicating directions and positions and such indicated by "up", "down", "front", "rear", "right" and "left" in FIGS. 1 and 2. In FIG. 1, the center axis $L_e$ is parallel to a vertical direction.

The outboard motor S has a transmission mechanism including a drive shaft 11 coaxially connected to the crankshaft 27 by a flywheel 10 fixedly mounted on the crankshaft 27 for rotation together with the crankshaft 27, a reversing mechanism 12 held in the gear case 4, and a propeller shaft 13 fixedly mounted with a propeller 14. The power of the internal combustion engine E is transmitted from the crankshaft 27 through the drive shaft 11 and the reversing mechanism 12 to the propeller 14 to drive the propeller 14 for rotation.

A mounting device for mounting the outboard motor S on the stern 19 of a hull B has a swivel shaft 15 fixed to the mount case 1 and the extension case 3, a swivel case 16 supporting the swivel shaft 15 for turning thereon, a tilting shaft 17 supporting the swivel case 15 so as to be turnable in a vertical plane, and a bracket 18 holding the tilting shaft 17 and attached to the stern 19 of the hull B. The mounting device holds the outboard motor S so as to be turnable on the tilting shaft 17 in a vertical plane relative to the hull B and so as to be turnable on the swivel shaft 15 in a horizontal plane.

Figure 3:
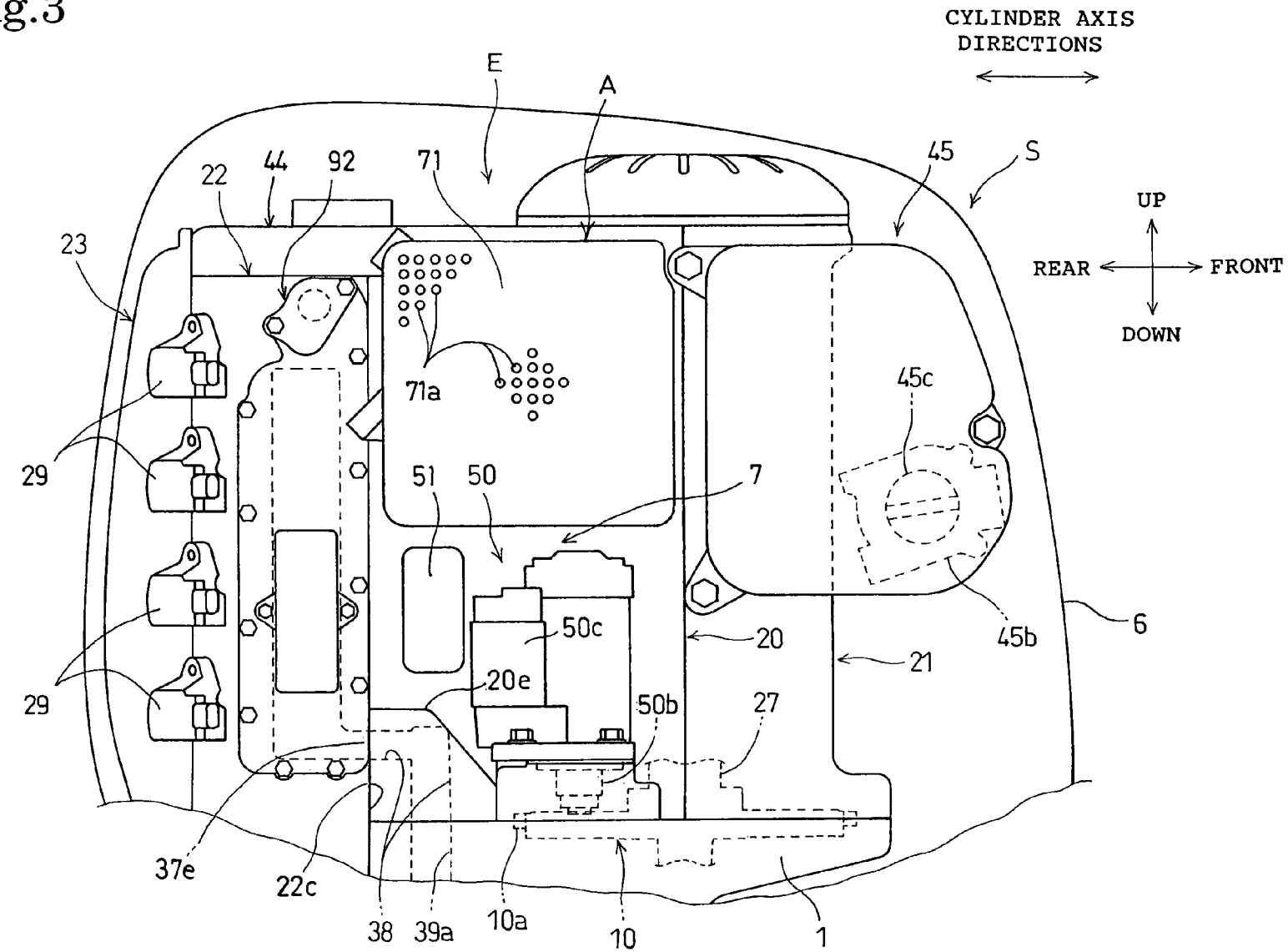
FIG. 3 is a side elevation of an essential part of the internal combustion engine shown in FIG. 1 taken from the right-hand side of the internal combustion engine.

Referring to FIGS. 2 and 3, the internal combustion engine E, which is a multi-cylinder 4-stroke internal combustion engine, has an engine body including a cylinder block 20 provided with four cylinders 20*a* arranged in a row in a vertical direction, a crankcase 21 joined to the front end of the cylinder block 20, a cylinder head 22 joined to the rear end of the cylinder block 20, a head cover 23 joined to the rear end of the cylinder head 22, and a transmission case 44.

Pistons 25 are fitted in the cylinders 20*a* for reciprocation in the cylinders 20*a*, respectively. The pistons 25 are connected to the crankshaft 27 supported on the crankcase 21 by connecting rods 26, respectively. The cylinder head 22 is provided with combustion chambers 30 respectively opposed to the pistons 26 with respect to a direction parallel to the axes $L_c$ of the cylinders 20*a*, intake ports 31 respectively opening into the combustion chambers 30, exhaust ports 32 respectively opening into the combustion chambers 30, and spark plugs 29 (FIG. 3) respectively facing the combustion chambers 30. In this specification, the direction parallel to the axes $L_c$ of the cylinders 20*a* will be referred to as "cylinder axis direction", which is parallel to the longitudinal direction. The spark plugs 29 are spark plugs with ignition coil integrally provided with an ignition coil. The crankshaft 27, namely, the output shaft of the internal combustion engine E, is held in a crank chamber 28. The crank chamber 28 is defined by the crankcase 21 and a cylinder block skirt 20*c* nearer to the crank-case 21 with respect to the cylinder axis direction than cylinder parts 20*b* corresponding to the moving range of the pistons 25.

As shown in FIG. 2, a vertical plane containing the axes $L_c$ of the cylinders 20*a* is displaced by an offset δ in a direction in which the crankshaft 27 rotates after the piston 25 has reached its top dead center from a vertical plane containing the center axis $L_e$ of the crankshaft 27 and parallel to the cylinder axes $L_c$. Thus the vertical plane containing the axes $L_c$ of the cylinders 20*a* is separated from the vertical plane containing the center axis $L_e$ of the crankshaft 27 by a distance equal to the offset δ toward the intake side of the internal combustion engine E. A vertical plane containing the horizontal center axis $L_o$ of the out-board motor S contains the center axis of the drive shaft 11 aligned, in this embodiment, with the center axis $L_e$ of the crankshaft 27.

Suppose that the engine body is divided into an intake part and an exhaust part by the vertical plane containing the center axis $L_o$ of the outboard motor S. Then, the intake part on the intake side includes the intake ports 31 and the exhaust part on the exhaust side includes exhaust passages 32 as viewed in a direction parallel to the center axis $L_e$ of the crankshaft 27.

The cylinder head 22 is provided with intake valves 35 for opening and closing the intake ports 31, and exhaust valves 36 for opening and closing the exhaust ports 32. The intake valves 35 and the exhaust valves 36 are driven for opening and closing operations in synchronism with the rotation of the crankshaft 27 by an overhead camshaft type valve train 42 disposed in a valve train chamber 41 defined by the cylinder head 22 and the head cover 23. The valve train 42 includes a camshaft 42*a* provided with valve cams 42*b*, intake rocker arms 42*c* driven by the valve cams 42*b*, and exhaust rocker arms 42*d* driven by the valve cams 42*b*. The camshaft 42*a* is driven for rotation by the crankshaft 27 through a belt-drive transmission mechanism 43 shown in FIG. 1. The intake valves 35 and the exhaust valves 36 are driven for opening and closing through the intake rocker arms 42*c* and the exhaust rocker arms 42*d*, respectively, by the valve cams 42*b*. The transmission mechanism 43 is covered from above by a transmission case 44 extending over the cylinder block 20, the crankcase 21, the cylinder head 22 and the head cover 23.

The internal combustion engine E has an intake system 45 for supplying intake air to the combustion chambers, and engine parts disposed outside the engine body or attached to the engine body.

The intake system 45 includes an inlet air silencer 45*a* having an air inlet, a throttle body 45*b* disposed in front of the crankcase 21 so as to receive air from the inlet air silencer 45*a* provided with a throttle valve 45*c*, and an intake manifold 45*d*, namely, an intake pipe, for carrying intake air taken in through the inlet air silencer 27*a* and metered by the throttle valve 45*c*.

The engine parts include electrical engine parts that operate on electricity. The electrical engine parts include a fuel supply system including fuel injection valves 46 and a fuel pump for supplying fuel by pressure to the fuel injection valves 46, an ignition system including the spark plugs 29 integrally provided with the ignition coils, respectively, and a starting system including a starting motor 50.

The intake air that flows through the intake passage in the intake system 45 is mixed with fuel injected by the fuel injection valves 46 attached to the cylinder head 22 to produce an air-fuel mixture. The air-fuel mixture is sucked through the intake ports 31 into the combustion chambers 30. Then, the air-fuel mixture is ignited by the spark plugs 29 and burns to produce a combustion gas. Thus the pistons 25 are reciprocated by the pressure of the combustion gas and drive the crankshaft 27 for rotation through the connecting rods 26.

The combustion gas discharged as exhaust gas from the combustion chambers 30 flows through the exhaust ports 32 into an exhaust passage 38 formed in the cylinder block 20. Then, the exhaust gas flows through a passage 39*a* (FIG. 1) formed in the mount case 1 and an exhaust guide passage 39 including a passage 39*b* and an expansion chamber 39*c*, and is discharged through a passage 39*e* formed in the body of the propeller 14 into the water.

The exhaust gas discharged from each combustion chamber 30 flows through the exhaust port 32 into an exhaust manifold passage 37. The exhaust manifold passage 37 is defined by a passage wall W formed integrally with a part of the cylinder head 22 on the exhaust side. The passage wall W defines also cylinder head water jackets $J_h$. The passage wall W is on the side of the head cover 23 relative to the joint surface 22*c* joined to the cylinder block 20 with respect to the cylinder axis direction. The exhaust passage 38 has an L-shaped sectional shape as shown in FIG. 3 and is formed at a lower end part of the cylinder block 20 on the exhaust side. The exhaust passage 38 has an inlet opening in the joint surface 22*c* and connected to the exhaust outlet 37*e* of the exhaust manifold passage 37, and an outlet connected to the passage 39*a* formed in the mount case 1 as shown in FIG. 1. Members forming the passages 37, 38 and 39 through which the exhaust gas flows constitute an exhaust system. In this specification, a side view is taken from a transverse direction perpendicular to the vertical plane containing the cylinder axes $L_c$. The transverse directions are rightward and leftward directions in this embodiment.

Figure 4:
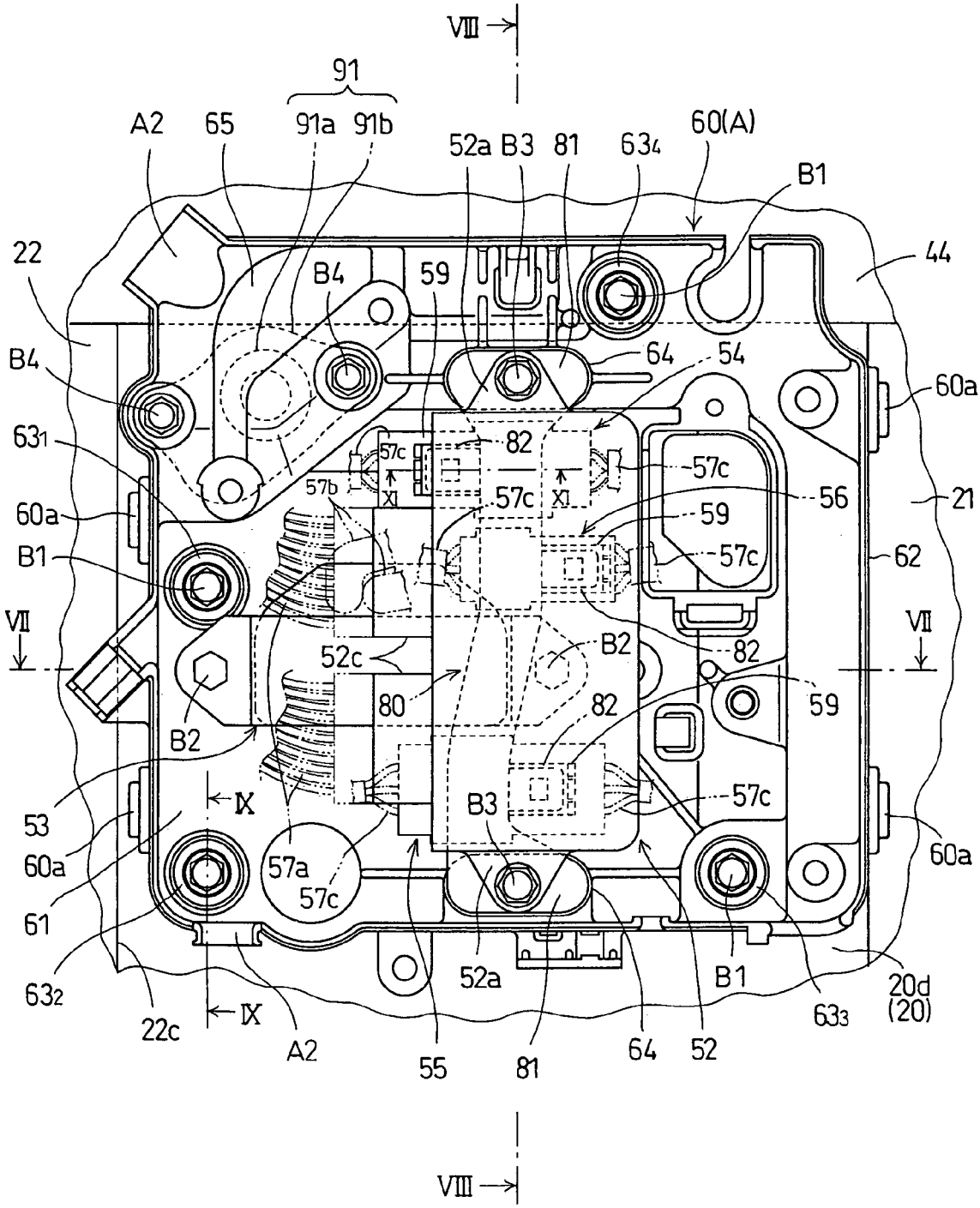
FIG. 4 is a side elevation of the electrical equipment holder shown in FIG. 3, in which a cover is removed.

Referring to FIGS. 2 to 4, the internal combustion engine E is provided with an electronic control unit (hereinafter, abbreviated to "ECU") 52 (FIG. 4) for controlling electrical engine parts to control the operation of the internal combustion engine E, a relay box 53 collectively holding power relays including those for connecting the ECU 52, the fuel pump and the starting motor 50 to a power supply, parts which are a fuse box 51 (FIG. 3) and couplers 54, 55 and 56 connecting wiring lines of circuits, and an electrical equipment box A, namely, an electrical equipment holder, holding the electrical parts including at least the ECU 52, the relay box 53 and the couplers 54, 55 and 56.

The electrical equipment box A is disposed beside the cylinder block 20, as shown in FIG. 2, in a recess 7 defined by the skirt 20*c* of the cylinder block 20 and the cylinder head 22 beside the cylinder block 20. The recess 7 is formed on the right-hand side of the cylinder part 20*b* and is transversely concave. As obvious from FIG. 3, the starting motor 50 and the fuse box 51 are disposed under the electrical equipment box A. The electrical equipment box A overlaps the starting motor 50, which integrally includes a solenoid actuator 50*c*, in a horizontal plane or when viewed vertically. The solenoid actuator 50*c* engages a pinion 50*b* mounted on the armature shaft of the starting motor 50 and disengages the same from a ring gear 10*a* on the flywheel 10. The fuse box 51 is placed in a space between the electrical equipment box A and a bulged part 20*e* corresponding to the exhaust passage 38 and bulging out to the right.

Referring to FIGS. 2 and 4 to 6, the electrical equipment box A is attached to an upper part (FIG. 3) of the side wall 20*d* (FIG. 6) of the cylinder block 20. The electrical equipment box A is disposed on the exhaust side so as to overlap the exhaust passage 38 when viewed vertically or in a horizontal plane. As obvious from FIG. 2, the electrical equipment box A is disposed in a space between the cylinder head 22 on the rear side with respect to the cylinder axis direction and the inlet air silencer 45*a* on the front side with respect to the cylinder axis direction with its rear end on the side of the cylinder head 22 located near the joint surface 23*c* and its front end on the side of the crankcase 21 located near the center axis $L_e$ of the crankshaft 27. Thus the electrical equipment box A is disposed in a region between the piston 25 at the top dead center (indicated by continuous lines in FIG. 2) and the piston 25 at the bottom dead center (indicated by two-dot chain lines in FIG. 2) with respect to the cylinder axis direction. Since the electrical equipment box A is disposed adjacent to the cylinder head 22, the inlet air silencer 45*a* can be placed in a space extending forward from a position near the center axis $L_e$ of the crankshaft 27. Therefore, the inlet air silencer may be of a large capacity. Thus the outboard motor S has a small dimension in the cylinder axis direction while exercising a high silencing performance.

Referring to FIGS. 4 to 8, the electrical equipment box A has a box-shaped body including a case 60 provided with hooks 60*a* (FIG. 5), namely, a first member, and a cover 70, namely, a second member, provided with latches 70*a* (FIG. 6), and a stay 80, namely, an attachment, combined with the case 60. The case 60 is fastened to the cylinder block 20 and the transmission case 44 with bolts B1 (FIG. 4). The latches 70*a* are engaged with the catches 60*a* to fasten the cover 70 detachably to the case 70. The case 60 and the cover 70 are made of a synthetic resin. The case 60 and the cover 70 defines an electrical equipment holding space A1 for holding the ECU 52, the relay box 53 and the couplers 54, 55 and 56 therein. The stay 80 is placed in the electrical equipment holding space A1 in the body.

The case 60 has a bottom wall 61 (FIG. 8) transversely facing the cylinder block 20, and a side wall 62 transversely extending from the substantially entire circumference of the bottom wall 61 toward the cover 70.

The cover 70 has a top wall 71 transversely opposed to the bottom wall 61, and a side wall 72 transversely extending from the circumference of the top wall 71 toward the case 60. The side wall 72 of the cover 70 surrounds an end part 62*a* (FIGS. 7 and 8) of the side wall 62 closely. Many through holes 71*a* are distributed substantially uniformly in the entire top wall 71. Some of the through holes 71*a* are shown in FIG. 3. The electrical equipment holding space A1 is ventilated and heat generated by the electrical parts including the ECU 52 is dissipated through the through holes 71*a*.

The bottom wall 61, the top wall 71, and the side walls 62 and 72 define the electrical equipment holding space A1.

Figure 5:
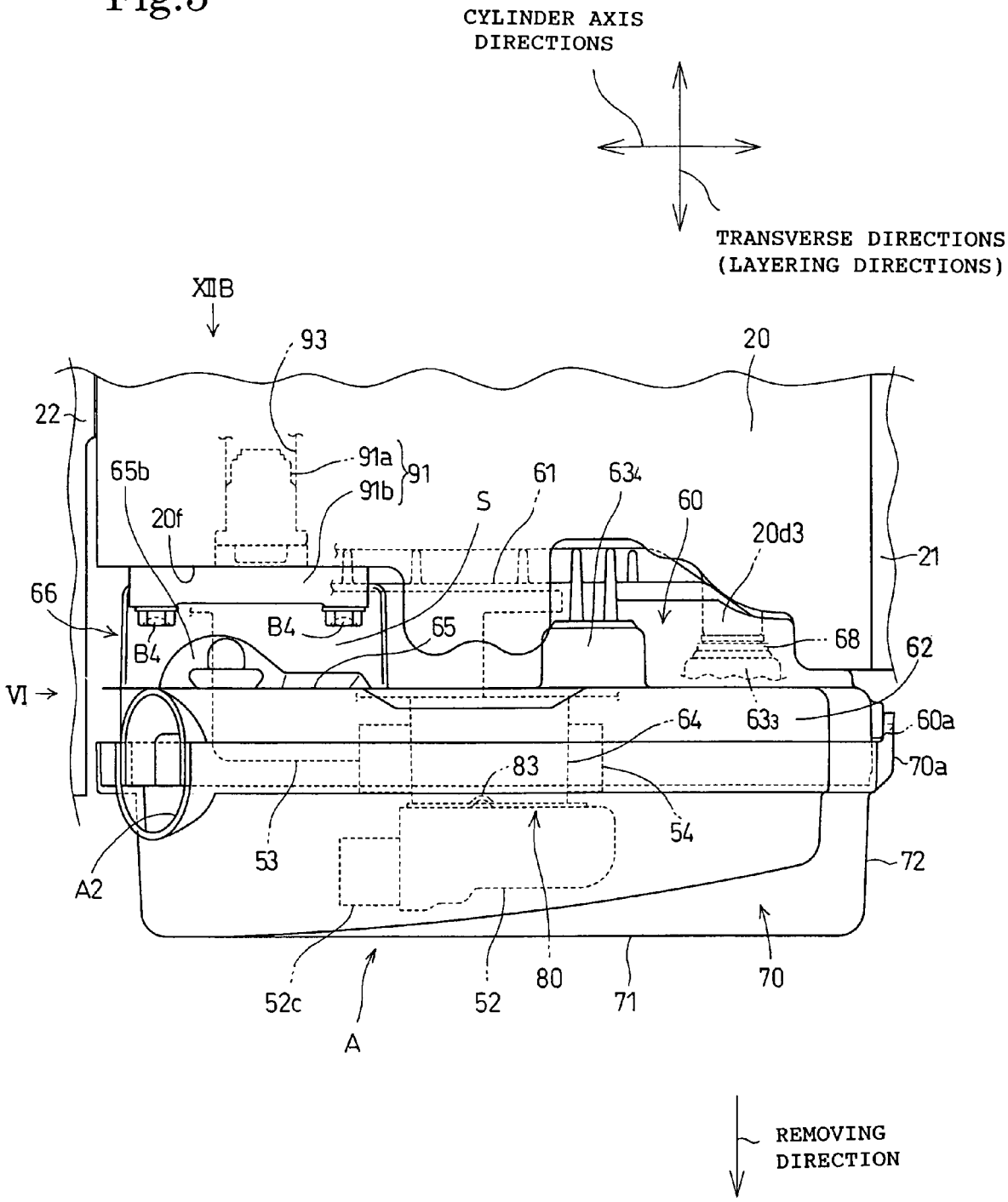
FIG. 5 is a plan view of an essential part of the internal combustion engine including the electrical equipment holder shown in FIG. 2.
Figure 6:
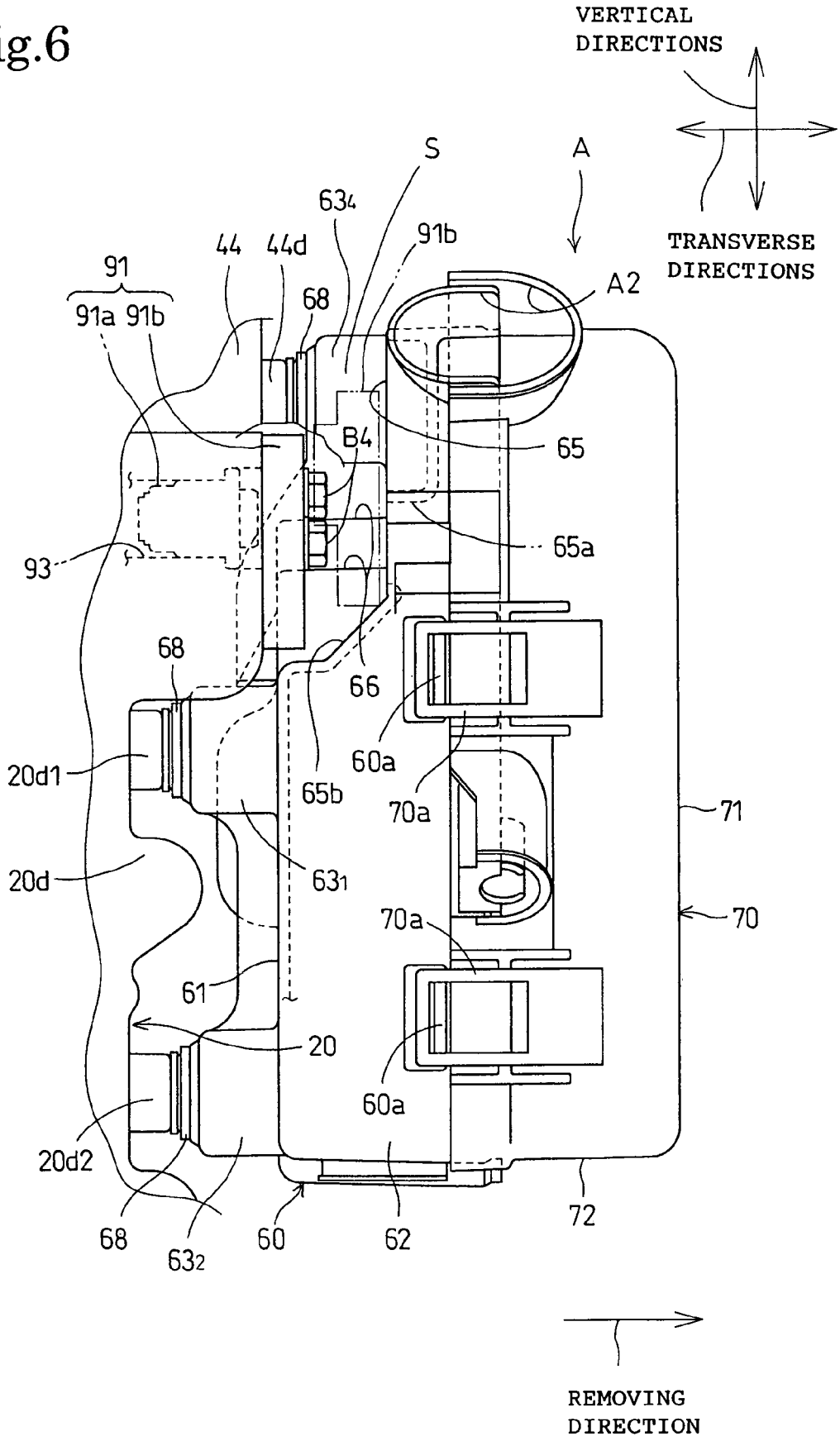
FIG. 6 is a view taken in the direction of the arrow VI in FIG. 5.
Figure 7:
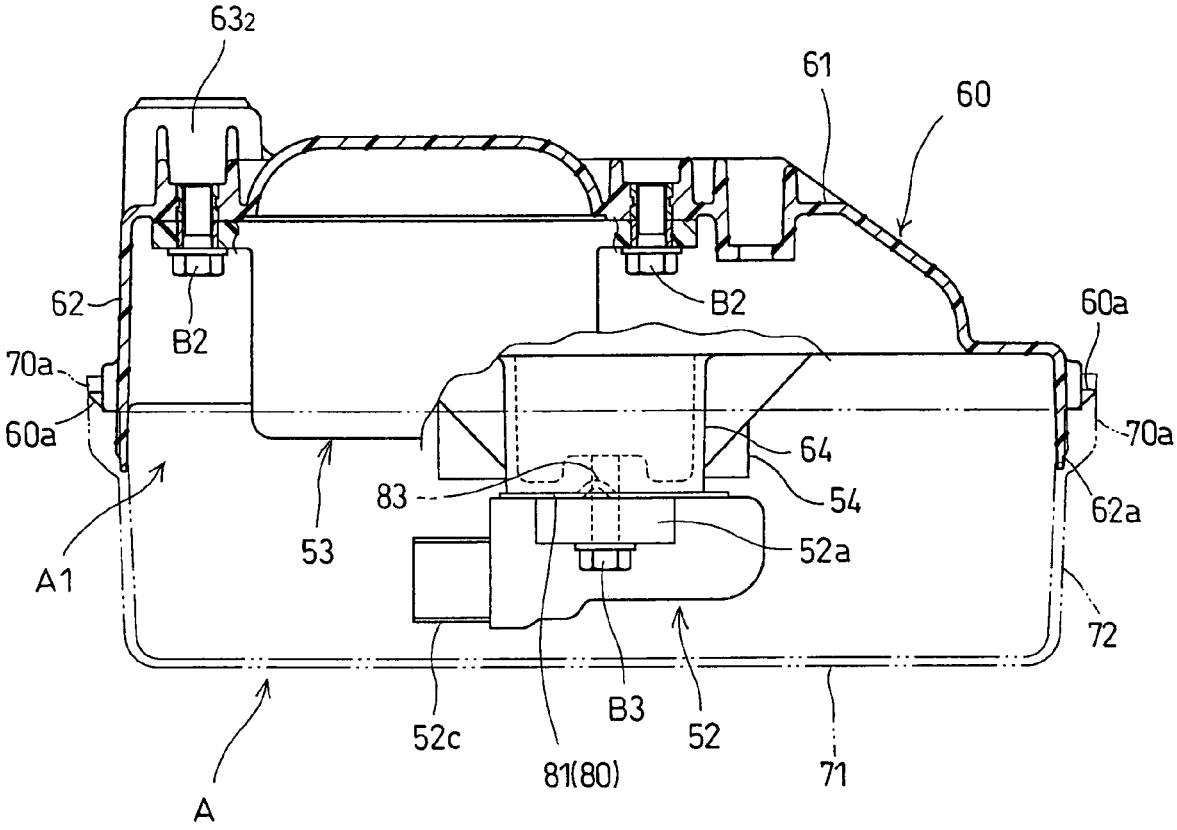
FIG. 7 is a schematic sectional view taken on the line VII-VII in FIG. 4.
Figure 9:
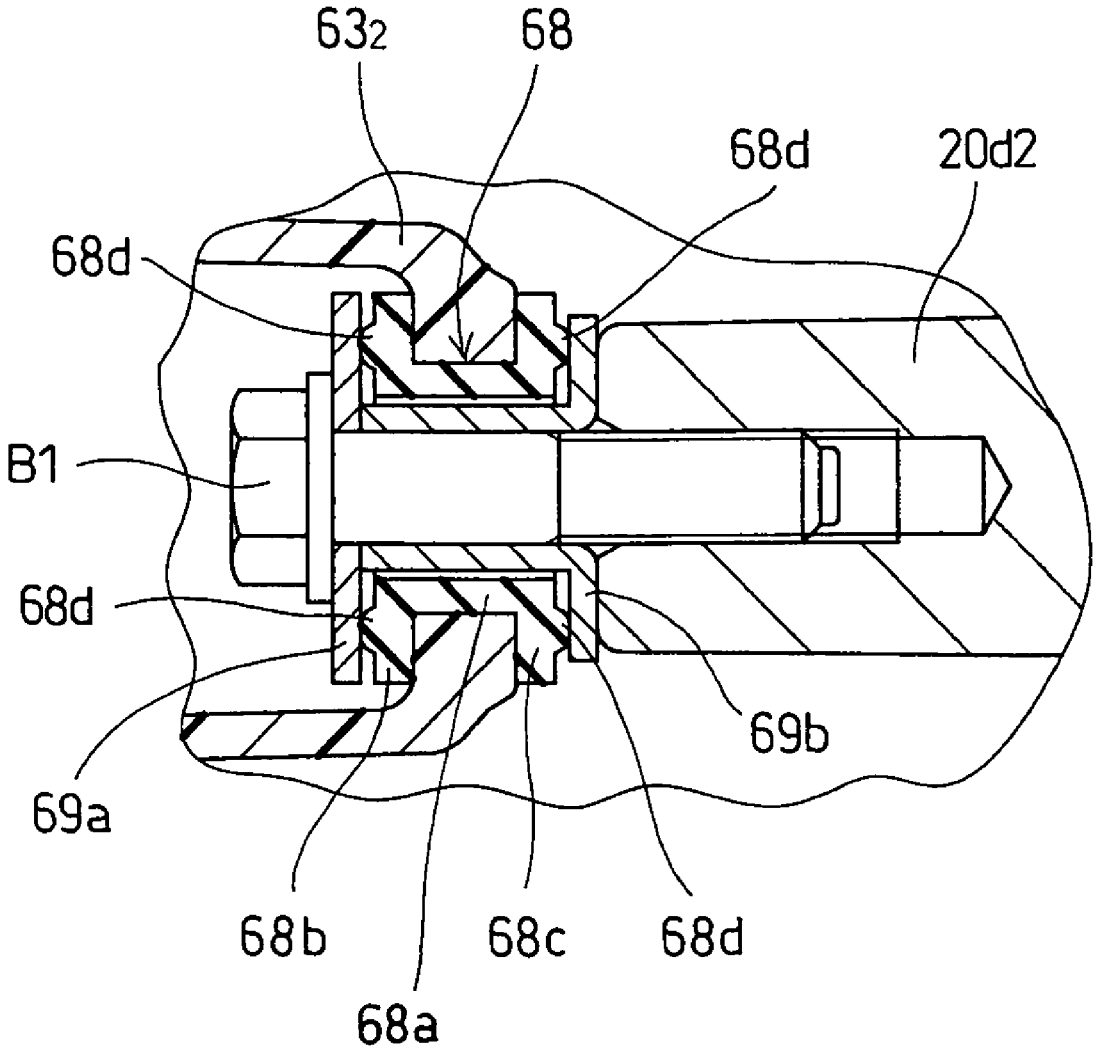
FIG. 9 is a schematic sectional view taken on the line IX-IX in FIG. 4.
Figure 10:
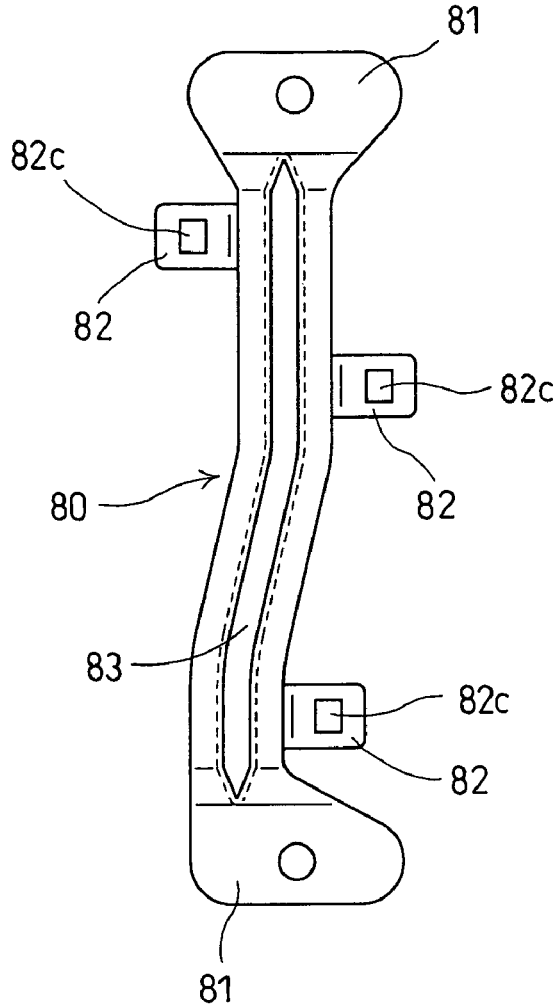
FIG. 10 is a side elevation of a stay holding the electronic equipment holder shown in FIG. 4.

Referring to FIGS. 5 and 6, the bottom wall 61 is provided with four cylindrical connecting parts $\mathbf{63}_1$, $\mathbf{63}_2$, $\mathbf{63}_3$ and $\mathbf{63}_4$ fastened to three mounting seats 20*d*1, 20*d*2 and 20*d*3 of the cylinder block 20 and a mounting seat 44*d* of the transmission case 44 with bolts B1, and a boss 64 to which the stay 80 is attached. Referring also to FIG. 9, rubber dampers 68 are attached to the connecting parts $\mathbf{63}_1$, $\mathbf{63}_2$, $\mathbf{63}_3$ and $\mathbf{63}_4$. The connecting parts $\mathbf{63}_1$, $\mathbf{63}_2$, $\mathbf{63}_3$ and $\mathbf{63}_4$ are fastened through the rubber dampers 68 to the mounting seat 20*d*1, 20*d*2, 20*d*3 and 44*d* with the bolts B1. Each of the rubber dampers 68 has a cylindrical body 68*a* provided with a bore for receiving the bolt B1, and flanges 68*b* and 68*c* formed on the opposite ends of the cylindrical body 68*a*, respectively. A plurality of spherical protrusions 68*d* are arranged on the outer surface of the flanges 68*b* and 68*c* at circumferential intervals. The protrusions 68*d* of the flange 68*b* are pressed against washers 69*a* and are elastically deformed. The protrusions 68*d* of the other flanges 68*c* are pressed against collars 69*b* fitted in the bores of the rubber dampers 68 and are elastically deformed. The collar 69*b* limits the compression of the rubber dampers 68. The distance between each of the washers 69*a* and the corresponding one of the mounting seats 20*d* 1, 20*d* 2, 20*d* 3 and 44*d* is determined by the collar 69*b*. The rubber dampers 68 absorb the vibration of the operating internal combustion engine E so that vibrations of the body, the stay 80, the relay box 53, the couplers 54, 55 and 56 and the ECU 52 held in the electrical equipment box A can be reduced to improve the reliability of those electrical parts. The type and hardness of the rubber forming the rubber dampers 68, and the shape of the rubber dampers 68 are selectively determined so that the rubber dampers 68 may most effectively reduce vibrations.

Referring to FIGS. 4 to 8, FIG. 8 in particular, the ECU 52, the relay box 53, and the couplers 54, 55 and 56 are disposed in a layered arrangement in the electrical equipment holding space A1. In this embodiment, the relay box 53 and the couplers 54, 55 and 56 are disposed in a layer and the ECU 52 is disposed in another layer transversely separated from the above layer. The ECU 52 overlaps the relay box 53 and the couplers 54, 55 and 56 with respect to a transverse direction. The electrical equipment box A has the bottom wall 61, the top wall 71 and the stay 80. The stay 80 is extended in a space between the bottom wall 61 and the top wall 71. The electrical equipment holding space A1 is divided by the stay 80 into a first space A1*a* between the stay 80 and the bottom wall 61, and a second space A1*b* between the stay 80 and the top wall 71.

Figure 8:
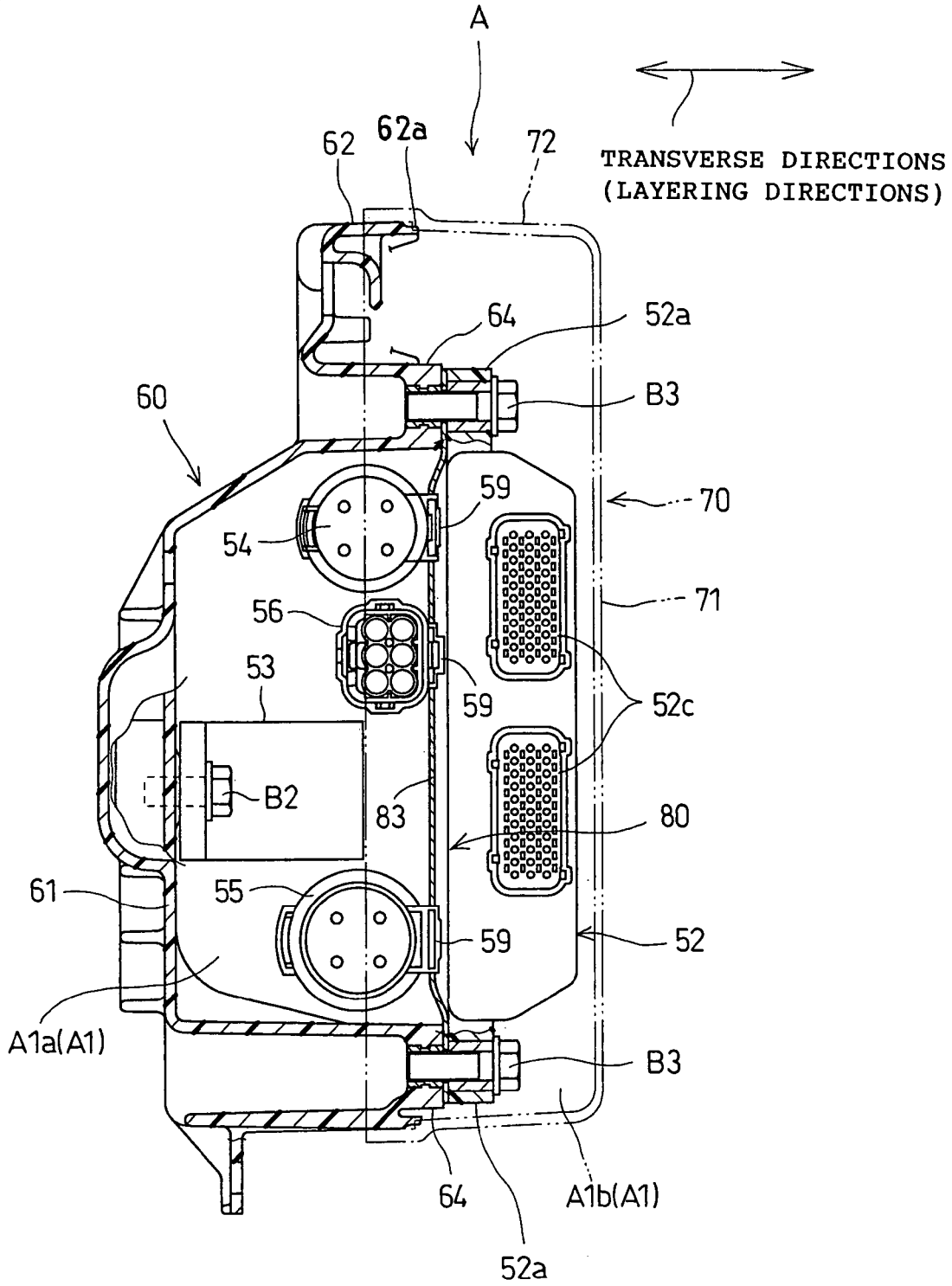
FIG. 8 is a schematic sectional view taken on the line VIII-VIII in FIG. 4.

The relay box 53, and the couplers 54, 55 and 56 are disposed in the first space A1*a*, and the ECU 52 is disposed in the second space A1*b*. The ECU 52, the relay box 53 and the couplers 54, 55 and 56 are spaced apart from each other. The relay box 53 is attached to the bottom wall 61 with bolts B2. The ECU 52 and the couplers 54, 55 and 56 are attached to attaching parts 81 and 82 (FIG. 4) of the stay 80 made of a metal, respectively. In this embodiment, the bottom wall 61 and the stay 80 of the electrical equipment box A are holding members for holding the ECU 52, the relay box 53 and the couplers 54, 55 and 56. As shown in FIG. 8, the relay box 53 and the couplers 54, 55 and 53 overlap each other with respect to the transverse direction and hence the electrical equipment box A has a small transverse dimension.

Figure 11:
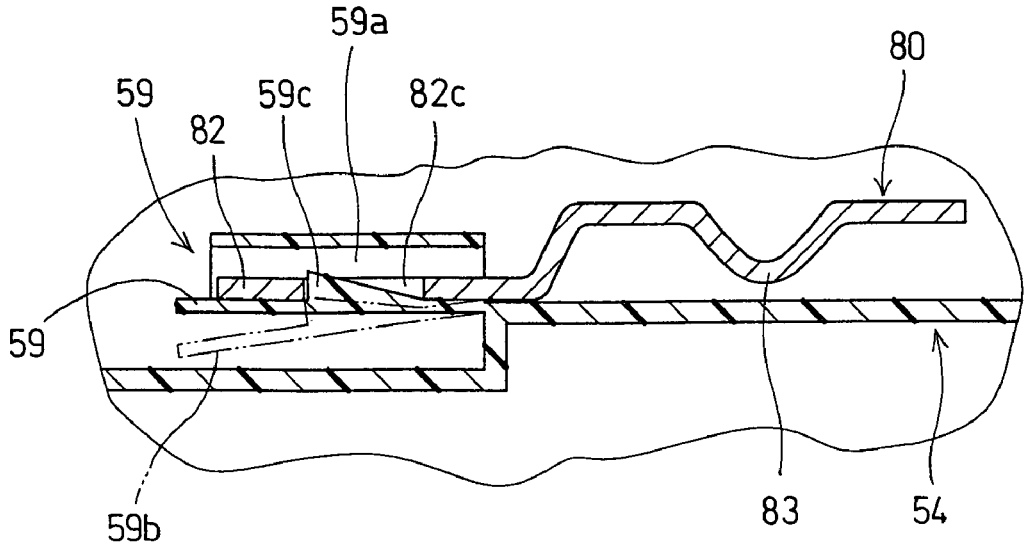
FIG. 11 is a sectional view taken on the line XI-XI in FIG. 4.

Referring to FIGS. 4, 5, 7, 8 and 10, the stay 80 having the shape of a plate is integrally provided with two mounting parts 81 (FIG. 10) to which two connecting parts 52*a* (FIG. 8) of the ECU 52 are fastened with bolts B3, respectively, and mounting parts 82 to which connecting parts 59 of the couplers 54, 55 and 56 are detachably attached by identical connecting mechanisms, respectively. The vertically extending stay 80 is provided with a rib 83, namely, a reinforcing part, for enhancing the lengthwise bending rigidity of the stay 80. The rib 83 has a length substantially equal to the distance between the two mounting parts 81. The rib 83 protruding toward the bottom surface 61 is formed by press working. Referring in addition to FIG. 11, the connecting mechanisms include the mounting parts 82, namely, hooking lugs, and elastically flexible, connecting tongues 59*b* placed in through opening 59*a* into which the mounting parts 82 are inserted, respectively. When the attaching parts 82 are inserted into the connecting parts 59, respectively, the attaching parts 82 push hooks 59*c* formed on the connecting tongues 59, respectively, to deform the connecting tongues 59 elastically. The hooks 59*c* engage in openings 82*c* formed in the attaching parts 82, respectively. Thus the couplers 54, 55 and 56 are attached to the stay 80.

As shown in FIG. 4, wires 57*a* connected to the connecting parts 52*c* of the ECU 52, wires 57*b* connected to the relay box 53, and wires 57*c* connected to the couplers 54, 55 and 56 are extended out of the electrical equipment box A through an opening A2 (FIGS. 5 and 6) formed in the side walls 62 and 72 and are connected to the electrical engine parts, respectively.

Referring to FIGS. 4, 5, 7 and 8, two bosses 64 (FIG. 8) formed integrally with the bottom wall 61 project toward the top wall 71. The bosses 64 are vertically spaced apart from each other on the opposite sides of the arrangement of the relay box 53 and the couplers 54, 55 and 56. The attaching parts 81 of the stay 80 are nearer to the top wall 71 than the relay box 53 and the couplers 54, 55 and 56. The attaching parts 81 are joined to the end surfaces of the bosses 64. Thus the bosses 64 are used to dispose the ECU 52, namely, a specified electrical part provided with a control circuit among the electrical parts, nearer to the top wall 71 than the other electrical parts including the relay box 53 and the couplers 54, 55 and 56 so that the ECU 52, the relay box 53 and the couplers 54, 55 and 56 can be arranged in layers in the electrical equipment holding space A1.

The ECU 52 is fastened together with the stay 80 to the two bosses 64 with the bolts B3. Thus the bosses 64 are interconnected by the stay 80 extending contiguously along the ECU 52. The bosses 64 serve as both support parts supporting the stay 80 and mounting parts on which the ECU 52 is mounted. Since the stay 80 is made of a metal having strength greater than that of the material forming the case 60, the stay 80 prevents the change of the vertical distance between the two bosses 64. Thus the stay 80 serves also as a reinforcing member for enhancing the rigidity of the bosses 64. The stay 80 also serves as a heat sink for promoting dissipation of heat from the ECU 52.

When the electrical equipment box A is disposed in an readily available space near the engine body so as to cover a small engine part smaller than the electrical equipment box A, such as a thermostat valve 91 (FIGS. 4 and 5) detachably attached to the cylinder block 20, the electrical equipment box A needs to be removed from the engine body to detach the small engine part for maintenance. Thus the maintenance of the small engine part requires troublesome work. In this embodiment, the electrical equipment box A is disposed so as to provide a working space S.

Figure 12A:
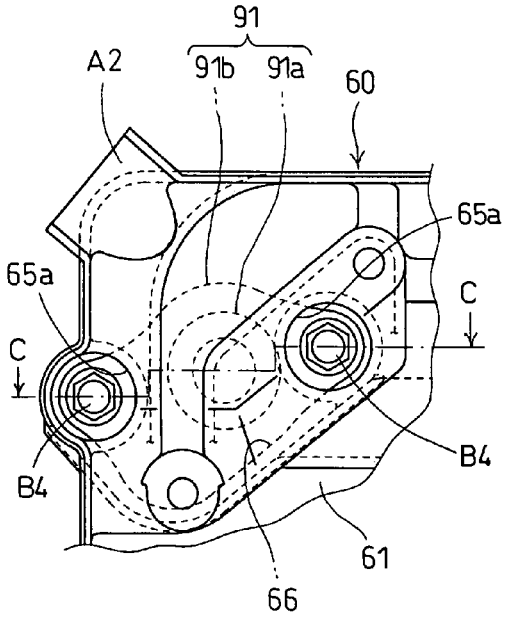
FIG. 12A is an enlarged view of a covering part of a case included in the electrical equipment holder shown in FIG. 4.
Figure 12B:
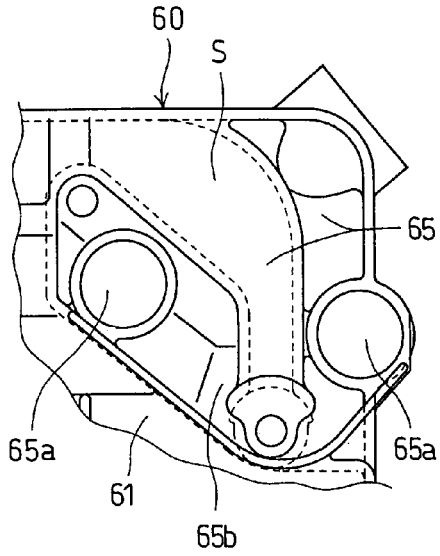
FIG. 12B is a view of the covering part taken in the direction of the arrow XIIB in FIG. 5.
Figure 12C:
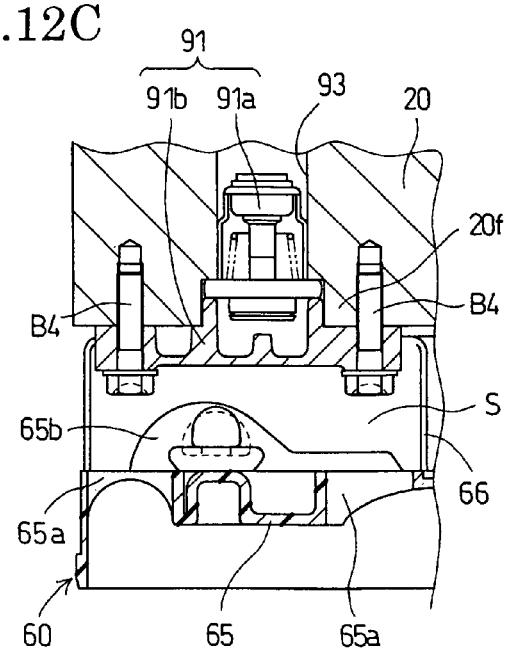
FIG. 12C is a sectional view taken on the line C-C in FIG. 12A.

Referring to FIGS. 4 to 6 and 12C, particularly, to FIGS. 6 and 12C, the electrical equipment box A is attached to the cylinder block 20 so as to cover the thermostat valve 91, namely, an engine part smaller than the electrical equipment box A, in a removing direction in which the thermostat valve 91 is removed from the engine block 20 in such a manner as to form a working space S opening upward, i.e., in a direction perpendicular to the removing direction, together with the engine body. The removing direction is parallel to the transverse direction. In this embodiment, a cylinder head thermostat valve 92 (FIG. 3) detachably attached to the cylinder head 22 controls the flow of cooling water through the cylinder head water jacket $J_h$.

The thermostat valve 91 is placed in a water passage 93 on the downstream side of a cylinder block water jacket $J_b$ formed in the cylinder block 20 so as to surround the cylinders 20*a*. The thermostat valve 91 includes a valve unit 91*a* operated by a temperature-sensing member, and a thermostat cover 91*b* pressing the valve unit 91*a* to a seat formed in the cylinder block 20 to fix the valve unit 91*a* to the cylinder block 20 and to seal the water passage 93. As viewed from above the thermostat valve 91, the thermostat cover 91*b* lies in the working space S and is fastened to the cylinder block 20 with two bolts B4 screwed in the transverse direction in threaded holes formed in the cylinder block 20.

Integrally formed in the bottom wall 61 of the case 60 are a covering part 65 covering the thermostat valve 91 from the removing direction, and a catching part 66 formed below the thermostat valve 91 and the bolts B4 so as to catch the thermostat valve 91 and the bolts B4 thereon when the thermostat valve 91 and the bolts B4 are removed from the cylinder block 20. The working space S is defined by the cylinder block 20 limiting one of the opposite transverse sides of the working space S, the covering part 65 limiting the other transverse side of the working space S, the catching part 66 defining the bottom of the working space S, a protruding part of the cylinder block 20 limiting one of opposite sides of the working space S with respect to the cylinder axis direction, and the cylinder head 22 limiting the other side of the working space S with respect to the cylinder axis direction.

The covering part 65 is formed by protruding a part of the bottom wall 61 in a transverse direction away from the cylinder block 20, i.e., in the transverse removing direction. When the electrical equipment box A is attached to the cylinder block 20, the covering part 65 is separated from a thermostat mounting part 20*f* of the cylinder block 20 by a distance that enables removing the thermostat cover 91*b* and the valve unit 91 a from the cylinder block 20, namely, a distance equal to the width of the working space S. The covering part 65 is provided with two through holes 65*a* through which the bolts B4 can be fastened and unfastened, and a sloping guide wall 65*b* for guiding the thermostat cover 91*b* removed from the cylinder block 20 upward. The covering part 65 thus formed by protruding a part of the bottom wall 61 of the case 60 in the removing direction provides the working space S.

The catching part 66 continuous with the lower end of the covering part 65 is a shelf extending from the lower end of the covering part 65 toward the cylinder block 20 and is convex downward.

When the maintenance of the thermostat valve 91 is necessary, the thermostat valve 91 is detached from and attached to the cylinder block 20 in the following manner.

The bolts B4 are unfastened with a tool passed through the through holes 65*a* to remove the thermostat cover 91*b* from the cylinder block 20. The bolts B4 and the thermostat cover 91*b* can be temporarily held on the catching part 66. Thus the catching part 66 prevents the bolts B4 unscrewed from the cylinder block 20 and the thermostat cover 91*b* removed from the cylinder block 20 from dropping down.

The bolts B4 are removed from within the working space S through the through holes 65*a*, and then the thermostat cover 91*b* is moved in the removing direction. Then, the thermostat cover 91*b* is guided upward by the guide wall 65*b* as indicated by two-dot chain lines in FIG. 6 and is extracted upward from within the working space S. Thus the guide wall 65*b* guides the thermostat cover 91*b* upward to facilitate taking out the thermostat cover 91*b* from the working space S.

Figure 12D:
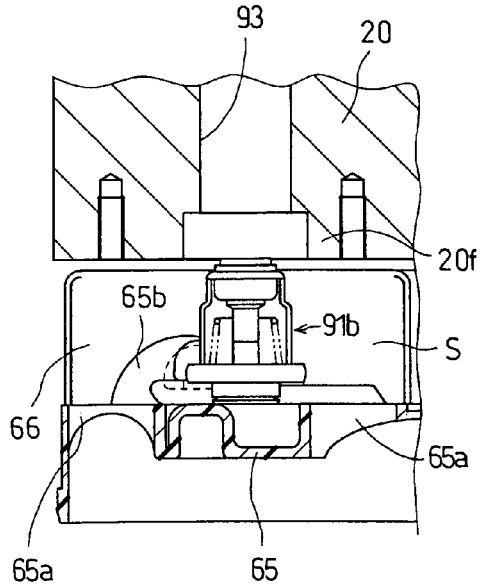
FIG. 12D is a view, corresponding to FIG. 12C, in which a valve body of a thermostat valve is removed.

Subsequently, the valve unit 91*a* is pulled out of the thermostat pocket of the cylinder block 20 and is held temporarily on the catching part 66 as shown in FIG. 12D. The catching part 66 prevents the valve unit 91*a* from dropping down. The valve unit 91*a* is held stably on the bottom of the downwardly convex catching part 66. Thereafter, the valve unit 91*a* is taken out upward from the working space S.

The foregoing thermostat removing procedure is reversed to attach the thermostat valve 91 to the cylinder block 20. The valve unit 91*a* and the thermostat cover 91*b* are attached in that order to the cylinder block 20. The working space S is thus used for attaching the thermostat valve 91 to and removing the same from the cylinder block 20.

The operation and effects of the embodiment will be described.

The ECU 52, the relay box 53, and the couplers 54, 55 and 56 are disposed in a layered arrangement in the electrical equipment box A. The electrical equipment box A has the bottom wall 61 and the stay 80 spaced apart from each other and serving as holding members for the layer of the relay box 53 and the couplers 54, 55 and 56 and the layer of the ECU 52. The relay box 53 and the couplers 54, 55 and 56, and ECU 52 are attached to the bottom wall 61 and the stay 80. The relay box 53 and the couplers 54, 55 and 56, and the ECU 52 are attached separately to the bottom wall 61 and the stay 80, respectively, in a three-dimensional arrangement. Therefore, the two-dimensional size of the electrical equipment box A in a plane perpendicular to the layering direction is small and the electrical equipment box A can be formed in small size and hence space for the electrical equipment box A can be easily secured outside the cylinder block 20. Since the relay box 53 and the couplers 54, 55 and 56, and the ECU 52 are attached separately to the bottom wall 61 and the stay 80, respectively, the relay box 53, the couplers 54, 55 and 56, and the ECU 52 can be securely held in the electrical equipment box A. Therefore, contact between those electrical parts can be avoided, vibrations of the relay box 53, the couplers 54, 55 and 56, and the ECU 52 caused by the vibration of the internal combustion engine E can be suppressed, those electrical parts are prevented from rubbing together, the relay box 53 and the couplers 54, 55 and 56 will not be exposed to heat generated by the ECU 52, and heat generated by the ECU 52 can be effectively dissipated.

The electrical equipment box A has the box-shaped body including the case 60 and the cover 70, and the stay 80. The relay box 53 is held on the case 60, and the couplers 54, 55 and 56 and the ECU 52 are held on the stay 80. Since the relay box 53 is held on the case 60, the body of the electrical equipment box A is small, as compared with that of an electrical equipment box having a case and a cover that do not hold any electrical parts.

The body forms the space A1 for holding the relay box 53, the couplers 54, 55 and 56, and the ECU 52, and the stay 80 is placed in the space A1. Therefore, the space A1 can be effectively used for holding the relay box 53, the couplers 54, 55 and 56, and the ECU 52 and hence the electrical equipment box A can be formed in small size.

The electrical equipment box A is placed in the transversely concave recess 7 defined by the cylinder block 20 and the cylinder head 22 of the engine body. Since the electrical equipment box A is placed in the recess 7 and the recess 7 is concave in the transverse direction, the electrical equipment box A can be closely and compactly combined with the engine body with respect to the transverse direction.

Since the vertical plane containing the axes $L_c$ of the cylinders is displaced toward the suction side, the recess 7 can be deeply indented in the intake side. Thus the electrical equipment box A can be disposed near the vertical plane containing the horizontal center axis $L_o$ of the outboard motor S by a distance corresponding to the offset $\delta$, and the transverse dimension of the outboard motor S can be reduced.

The two bosses 64 to which the ECU 52, namely, an electrical control device, is attached are projected from the bottom wall 61 of the electrical equipment box A, and the stay 80 interconnects the bosses 64. Since the ECU 52 is attached to the two bosses 64 projecting from the bottom wall 61 so as to be separated from the relay box 53 and the couplers 54, 55 and 56, the thermal influence of the ECU 52 on the relay box 53 and the couplers 54, 55 and 56 can be better suppressed and heat generated by the ECU 52 can be more satisfactorily dissipated than in a case in which the ECU 52 and the other electrical parts are disposed in a planar arrangement. Consequently, the electrical equipment box A can be formed in small size and hence a space for placing the electrical equipment box A can be easily secured. Since the rigidity of the two bosses 64 can be enhanced by the stay 80 interconnecting the bosses 64, the deformation of the bosses 64 and the change of the distance between the bosses 64 by vibrations generated by the operating internal combustion engine E can be prevented, the deformation of the ECU 52 can be prevented, the vibration of the ECU 52 caused by the operation of the internal combustion engine E can be suppressed, and the reliability of the ECU 52 can be enhanced.

The electrical equipment box A is so attached to the cylinder block 20 as to cover the thermostat valve 91 detachably attached to the cylinder block 20 from the removing direction and so as to form the working space S opening in the direction perpendicular to the removing direction together with the cylinder block 20. The thermostat valve 91 is attached to and removed from the cylinder block 20 through the working space S. Thus the electrical equipment box A does not need to be so disposed as to avoid overlapping the thermostat valve 91, and the disposition of the electrical equipment box A is not restricted at all by the thermostat valve 91. Therefore, a space for the electrical equipment box A can be easily secured. The electrical equipment box A is attached to the cylinder block 20 so as to form the working space S together with the cylinder block 20. The thermostat valve 91 can be attached to and removed from the cylinder block 20 for maintenance with the electrical equipment box A attached to the cylinder block 20. Thus the working space S facilitates maintenance work.

The catching part 66 defining the bottom of the working space S prevents the unscrewed bolts B4 and the thermostat valve removed from the cylinder block 20 from dropping down. The catching part 66 can temporarily hold the bolts B4 and the thermostat valve 91. Thus the catching part 66 facilitates removing work for taking out the bolts B4 and the thermostat valve 91 from the working space S and attaching work for attaching the thermostat valve 91 to the cylinder block 20.

Modifications of the foregoing embodiment will be described.

The small engine parts may be an anode metal and a relief valve of the cooling system placed in the cooling water passage, may be engine parts other than those of the cooling system, such as sensors for sensing operating conditions of the internal combustion engine.

The top wall 71 of the electrical equipment box A may be used for holding electrical parts in addition to the bottom wall 61 and the stay 80.

The bottom wall 61 may be provided with three or more bosses 64 and the stay 80 may be provided with three or more attaching parts to be attached to the three or more bosses 64.

The internal combustion engine E may be incorporated into a machine other than the outboard motor S, such as a vehicle or a working machine.

What is claimed is:

1. An internal combustion engine comprising:

an engine body; and an electrical equipment holder holding a plurality of electrical parts, said electrical equipment holder comprising a hollow case, a cover which is removably attachable to the case, and a connecting member, the case comprising a bottom wall and a plurality of bosses extending outwardly from said bottom wall;

wherein the connecting member extends from one of said bosses to another of said bosses and is connected thereto;

wherein the electrical parts are held in a layered arrangement in the electrical equipment holder including at least one electrical part attached to the bottom wall of the case, at least one electrical part spaced away from the bottom wall of the case on an inner surface of the connecting member, and at least one electrical part disposed outside of the connecting member; and wherein the electrical equipment holder is provided with a plurality of holding parts arranged at intervals in a direction in which the electrical parts are layered, and each of the holding parts holds at least one of the electrical parts.

2. The internal combustion engine according to claim 1, wherein the electrical equipment holder has a box-like body including the case and the cover, and a plurality of attachments placed in the body, and wherein the body and the attachments form the holding parts.

3. The internal combustion engine according to claim 1, wherein the body defines a holding space for holding the electrical parts therein, wherein the at least one electrical part disposed outside of the connecting member comprises an electronic control unit (ECU), and wherein the attachments are placed in the holding space defined by the body.

4. The internal combustion engine according to claim 1, wherein the engine body comprises a cylinder block and a cylinder head which cooperate to form a recess, and wherein the electrical equipment holder is disposed in said recess, which is included in the engine body and depressed in a direction in which the layers of the electrical parts are arranged.

5. An internal combustion engine comprising:

an engine body; and an electrical equipment holder holding a plurality of electrical parts including an electric control device provided with a control circuit, and disposed outside the engine body;

wherein the electrical equipment holder has a bottom wall provided with a plurality of supporting bosses to which the electric control device is attached, and the plurality of supporting bosses are interconnected by a connecting member extending along the electric control device; and wherein the electrical parts are held in a layered arrangement in the electrical equipment holder including at least one electrical part attached to the bottom wall, at least one electrical part spaced away from the bottom wall on an inner surface of the connecting member, and said electric control device disposed outside of the connecting member.

6. The internal combustion engine according to claim 5, wherein the connecting member is a plate-shaped stay, the electric control device is attached to one of two opposite surfaces of the stay, and other electrical parts are attached to the other surface of the stay.

7. The internal combustion engine according to claim 6, wherein the electrical equipment holder is an electrical equipment box having said bottom wall facing the engine body, wherein the stay is spaced away from the bottom wall by said bosses, a first space extends between the stay and the bottom wall, and a second space extends on the opposite side of the first space with respect to the stay.

8. An internal combustion engine comprising:

an engine body; and an electrical equipment holder holding a plurality of electrical parts and disposed outside the engine body, said electrical equipment holder comprising a hollow case, a cover which is removably attachable to the case, and a connecting member, the case comprising a bottom wall and a plurality of bosses extending outwardly from said bottom wall;

wherein at least one of said electrical parts is attached to said bottom wall and spaced away from said connecting member;

wherein the connecting member extends from one of said bosses to another of said bosses and is connected thereto; and wherein the electrical equipment holder is attached to the engine body so as to cover an engine part detachably attached to the engine body in a removing direction in which the engine part is removed from the engine body and so as to form a working space opening in a direction perpendicular to the removing direction together with the engine body, and the engine parts can be attached to and removed from the engine body through the working space.

9. The internal combustion engine according to claim 8, wherein the electrical equipment holder is provided with a catching part extending in a shape of a shelf under the working space to support the engine part removed from the engine body.

10. The internal combustion engine according to claim 8, wherein the electrical equipment holder is provided with a guide wall for guiding the engine part removed from the engine body in a direction perpendicular to the removing direction.

* * * * *